US006293050B1

(12) United States Patent
Jöhnk

(10) Patent No.: US 6,293,050 B1
(45) Date of Patent: Sep. 25, 2001

(54) AUTOMATIC DOOR OR HOOD OPENING ARRANGEMENT FOR A MOTOR VEHICLE INCLUDING A PNEUMATIC SPRING AND EJECTOR COMBINATION

(75) Inventor: Benno Jöhnk, Isenbüttel (DE)

(73) Assignee: Volkswagen AG (DE)

( * ) Notice: Subject to any disclaimer, the term of this patent is extended or adjusted under 35 U.S.C. 154(b) by 0 days.

(21) Appl. No.: 09/480,550

(22) Filed: Jan. 10, 2000

(30) Foreign Application Priority Data

Feb. 2, 1999 (DE) ..... 199 04 098

(51) Int. Cl.[7] ..... E05F 11/54; E05F 1/14
(52) U.S. Cl. ..... 49/276; 49/386; 49/339
(58) Field of Search ..... 296/56; 49/340, 49/341, 339, 330, 25, 276, 277, 278, 386, 387

(56) References Cited

U.S. PATENT DOCUMENTS

| | | | | |
|---|---|---|---|---|
| Re. 36,267 | * | 8/1999 | Moore et al. | 49/340 |
| 2,361,040 | * | 10/1944 | Larsen | 49/340 |
| 3,713,472 | * | 1/1973 | Dozois | 160/189 |
| 4,183,177 | * | 1/1980 | Kurdziel | 49/25 |
| 4,623,132 | | 11/1986 | Smith . | |
| 4,679,841 | * | 7/1987 | Taunay | 296/76 |
| 5,147,106 | * | 9/1992 | Bartelt et al. | 296/202 |
| 5,222,328 | | 6/1993 | Okumura . | |
| 5,369,911 | | 12/1994 | Fortunato . | |
| 5,448,856 | * | 9/1995 | Moore et al. | 49/340 |
| 5,588,258 | * | 12/1996 | Wright et al. | 49/340 |
| 5,929,769 | | 7/1999 | Garnault . | |
| 6,055,775 | * | 5/2000 | Dering et al. | 49/340 |
| 6,055,776 | * | 5/2000 | Dettling et al. | 49/341 |

FOREIGN PATENT DOCUMENTS

| | | |
|---|---|---|
| 19758130 | 9/1998 | (DE) . |
| 29623461 | 9/1998 | (DE) . |

* cited by examiner

*Primary Examiner*—Gregory J. Strimbu
(74) *Attorney, Agent, or Firm*—Baker Botts LLP

(57) ABSTRACT

An arrangement for automatic opening of a motor vehicle rear door which can be pivoted about a horizontal swivel axis contains a pneumatic spring-and-ejector combination in which a pneumatic spring is pivotally connected to the vehicle and the rear door so that it exerts a closing torque on the door when the door is in a closed and a predetermined partially open position, and exerts an opening torque when the door is opened beyond the predetermined position to swing the door fully open. An ejector is arranged to pivot the door from the closed position to a position past the partially open position, thereby reducing the energy requirement of the ejector and avoiding high frictional forces in the door lock.

3 Claims, 1 Drawing Sheet

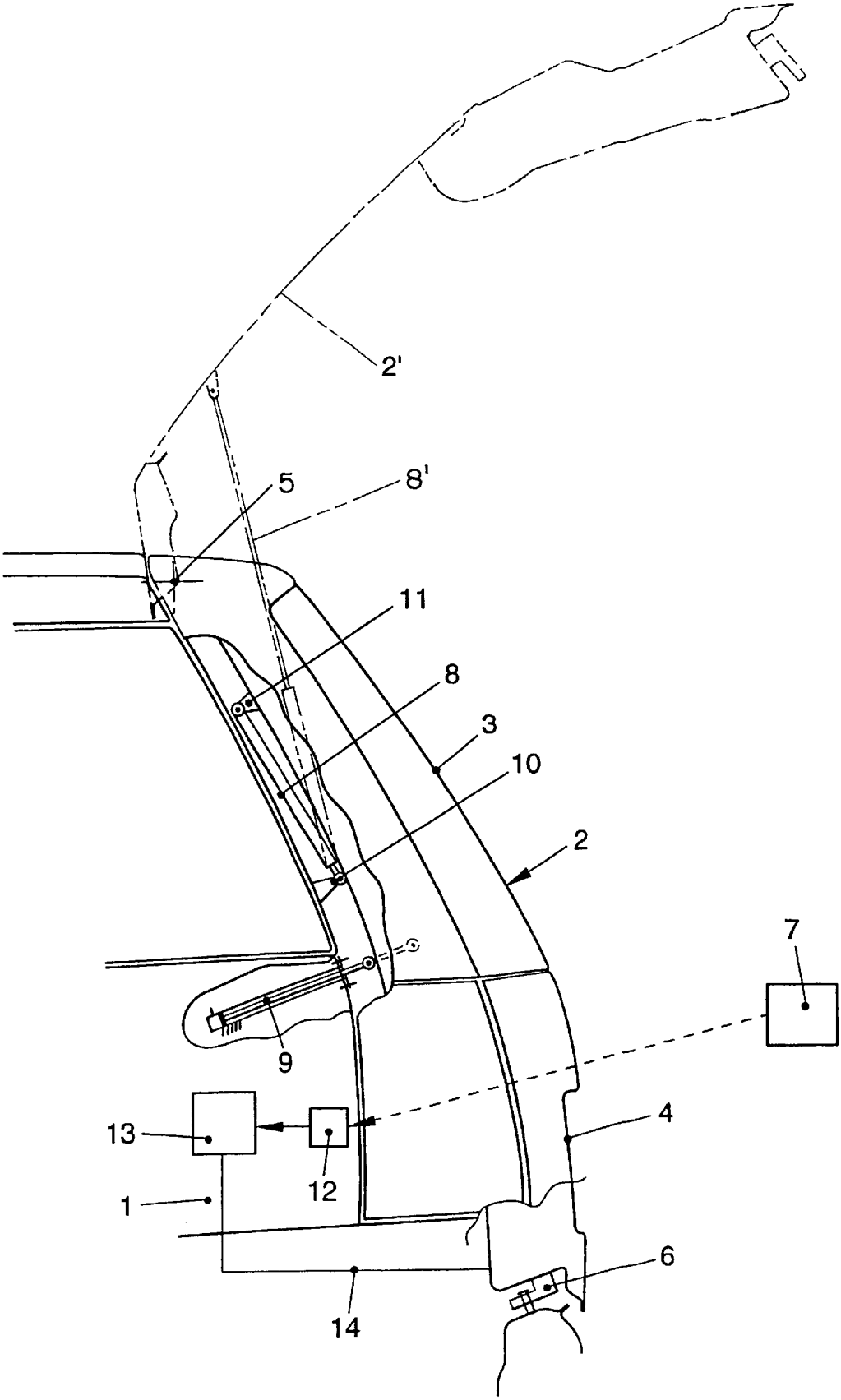
2'
5
8'
11
8
3
10
2
7
9
13
12
4
1
6
14

AUTOMATIC DOOR OR HOOD OPENING ARRANGEMENT FOR A MOTOR VEHICLE INCLUDING A PNEUMATIC SPRING AND EJECTOR COMBINATION

BACKGROUND OF THE INVENTION

This invention relates to arrangements for automatically opening a door, hood trunk lid or the like for a motor vehicle. Such components to be opened automatically are usually motor vehicle trunk lids or rear liftgates that swing upwardly and are referred hereinafter as "doors".

In addition to arrangements which permit opening of a vehicle door by the manual application of opening forces, arrangements are also known which relieve human beings of the need to apply door opening forces and use motors for this purpose. One example of this type is disclosed in German Offenlegungschrift No. 40 40 372, in which a trunk lid can be opened and closed by a vehicle occupant from inside the vehicle by turning on a motor. Disadvantages of this arrangement include a relatively large energy expenditure, since the motor clearly must accomplish the entire opening motion of the door, and also the fact that it is not possible to open the trunk lid from outside the vehicle in this manner.

The latter disadvantage is avoided by an arrangement described in German Gebrauchsmuster No. 296 23 461, which includes a portable remote control unit for initiating unlocking and opening of a door. That arrangement is said to be useful in general for controlling the unlocking and/or opening of any device for opening a component of a motor vehicle, but it is not clear from the document what form the device for generating the opening forces should take.

U.S. Pat. No. 5,369,911 describes a motor vehicle door which can be unlocked by a wireless transmitter for actuating an ejector which is constantly kept under spring pressure. Once the vehicle door is unlocked by receipt of a transmitted signal, the ejector is driven by the spring to push the door into an open position.

This arrangement is disadvantageous because the ejector also exerts a relatively large torque on the door in the opening direction when the door is in its latched position. That torque must be absorbed by the latch, with the result that the unlocking force must overcome relatively large frictional forces in the latch.

SUMMARY OF THE INVENTION

Accordingly it is an object of the invention to provide an automatic door opening arrangement for motor vehicles which overcomes disadvantages of the prior art.

Another object of the invention is to provide a door opening arrangement which permits complete freedom with respect to the type and design of the signal transmitter, which can be a portable radio command transmitter for sending wireless signals or a pressure pulse transmitter on the vehicle, and which also assures full opening of the door without requiring application of force by a human operator and with no need to overcome high surface pressures and thus frictional forces applied to the latch when the door is in the closed position.

These and other objects of the invention are attained by providing a pneumatic spring and ejector arrangement having a swivel mounting on the door to be opened and on the vehicle body in which the pneumatic spring exerts a closing torque on the door when the door is closed and only partially open and exerts an opening torque on the door when the door is opened to a predetermined position in which the ejector is actuated by a transmitted signal to open the door to the predetermined position.

Thus, the ejector of the pneumatic spring and ejector combination is arranged so that the ejector only opens the door from its closed position, after the door has been unlocked, to a predetermined position somewhat past a partially open position at which the pneumatic spring, as a result of an appropriate arrangement of the pivoted connection points of the pneumatic spring with the body and the door begins to exert an opening torque on the door and exerts a closing force at positions at which the door is open less than at the predetermined position. For this purpose, the pneumatic spring has a dead center position at the predetermined partially open position of the door and the ejector need only be arranged so that it pushes the door past the dead center position of the pneumatic spring. Further opening of the door takes place without requiring the addition of energy, that is, solely under the influence of the energy stored in the pneumatic spring.

BRIEF DESCRIPTION OF THE DRAWING

Further objects and advantages of the invention will be apparent from a reading of the following description in conjunction with the accompanying drawing which is a fragmentary view showing the rear portion of a vehicle containing a representative automatic door opening arrangement in accordance with the invention for opening a rear liftgate door which swings upwardly.

DESCRIPTION OF PREFERRED EMBODIMENT

In the typical embodiment of the invention shown in the drawing, a rear liftgate door 2 covers an opening in a vehicle rear body region I of a motor vehicle in an arrangement that is conventional and thus requires no detailed description. The rear door 2 contains a rear window 3 and has a receptacle area 4 for a license plate and can be pivoted about a horizontal swivel axis 5 between a closed position and an open position designated 2'. A latch 6 of conventional construction, for example a rotary spring lock, retains the rear door 2 in its closed position.

A pneumatic spring and ejector combination includes a pneumatic spring 8 of conventional construction and an ejector 9 formed by a piston and cylinder arrangement providing a combination which automatically opens the rear door 2 and swings it up to its fully open position 2' when a wireless command has been transmitted to a receiving 12 by an infrared transmitter 7, which, for example, can be integrated in a vehicle key. The ejector 9 is attached only to the vehicle body 1 and has a free, right-hand end, as seen in the drawing, which engages an area of the rear door 2 so as to transmit pressure to the door when activated. The pneumatic spring 8 is pivotally-mounted at one end 10 to the body 1 and at its other end 11 to the rear door 2. By appropriate selection of the locations of the pivot points 10 and 11 for the pneumatic spring 8 with respect to the swivel axis 5 of the rear door 2, the orientation of the axis of the pneumatic spring 8 is chosen so that it exerts a closing torque on the door when the door is in a position between its fully closed position and a predetermined partially open position at which it is at dead center, and in positions past the dead center position the pneumatic spring exerts an opening torque which is sufficient to pivot the rear door 2 into its fully opened position 2'.

On the other hand, the ejector 9 is designed so that the addition of energy to the left-hand chamber as seen in the drawing causes the ejector to extend its piston just far enough to pivot the rear door 2 a short distance past the predetermined partially open position to a point at which the pneumatic spring 8 exerts an opening torque on the real door 2. This assures that the major part of the opening motion of the rear door 2, and also that portion of the motion in which the weight of the door generates a closing torque, is achieved without the addition of energy from the ejector and takes place solely as a result of the energy stored in the pneumatic spring 8. The ejector 9 is then restored to its starting position.

As mentioned above, the opening action of the rear door 2 is initiated by a wireless signal from the portable command transmitter 7. This wireless signal is received by the receiver 12 and processed so that the receiver activates a control unit 13 to pressurize the left chamber of the ejector 9 as seen in the drawing. In the illustrated embodiment, the ejector 9 is actuated by the addition of pneumatic energy but other forms of energy can also be used.

In order to unlock the lock 6 before the opening motion of the rear door 2 starts, a signal is applied to the latch 6 through the signal line 14.

Because the pneumatic spring 8 exerts only a small closing torque on the rear door 2 when it is closed and latched, the cooperating latch components of the lock 6 are largely relieved of pressure during their unlocking movement and high frictional latch forces need not be overcome during unlocking. This low frictional force condition also applies when the free striker end of the ejector 9 contacts the region of the rear door 2 to initiate the opening of the door.

Accordingly, the invention provides an automatic door opening arrangement which makes possible automatic opening of a motor vehicle rear door or hood with little additional cost using conventional proven components in a manner which is optimized with respect to energy consumption.

Although the invention has been described herein with reference to specific embodiments, many modifications and variations therein will readily occur to those skilled in the art. Accordingly, all such variations and modifications are included within the intended scope of the invention.

I claim:

1. A vehicle body arrangement comprising a vehicle body having a swivel-mounted door which can be pivoted between an open position and a closed position about a horizontal swivel axis, a command transmitter, and a pneumatic spring-and-ejector combination including a pneumatic spring which is pivotally-mounted at one end to the door and pivotally mounted at another end to the vehicle body at locations which are selected relative to the swivel axis of the door so that the pneumatic spring exerts a closing torque on the door when said door is in the closed position and in a predetermined partially open position and exerts an opening torque on the door when the door is opened beyond the predetermined partially open position to pivot the door into said open position, and an ejector comprising a piston and cylinder device having a projectable free end which is engageable with the door and operable to swing the door from said closed position to a position beyond the predetermined partially open position in response to a signal from the command transmitter.

2. An arrangement according to claim 1 wherein the command transmitter is a mechanical pressure pulse transmitter on the vehicle body.

3. An arrangement according to claim 1 wherein the command transmitter is a portable wireless transmitter.

* * * * *